US006498129B1

(12) United States Patent
Meny et al.

(10) Patent No.: US 6,498,129 B1
(45) Date of Patent: Dec. 24, 2002

(54) TWO-CYCLE LUBRICATING OIL CONTAINING POLYISOBUTYLENE AMINE

(75) Inventors: Emil J. Meny, Summit; Rolfe J. Hartley, Cranbury, both of NJ (US)

(73) Assignee: Exxon Chemical Patents INC., DE (US)

( * ) Notice: Subject to any disclaimer, the term of this patent is extended or adjusted under 35 U.S.C. 154(b) by 0 days.

(21) Appl. No.: 09/149,328

(22) Filed: Sep. 8, 1998

(51) Int. Cl.[7] ..... C10M 149/22; C10M 143/06; C10M 149/00

(52) U.S. Cl. ..... 508/293; 508/545; 508/558; 508/591

(58) Field of Search ..... 508/293, 591, 508/545, 558; 44/412, 459, 331

(56) References Cited

U.S. PATENT DOCUMENTS

| | | | | | |
|---|---|---|---|---|---|
| 4,740,321 | A | * | 4/1988 | Davis et al. | 508/558 |
| 5,330,667 | A | * | 7/1994 | Tiffany, III | 252/49.6 |
| 5,498,353 | A | * | 3/1996 | Lin | 252/33.4 |

FOREIGN PATENT DOCUMENTS

| | | | | |
|---|---|---|---|---|
| EP | 0 704 519 A1 | | 4/1996 | C10L/1/14 |
| WO | 9113950 | * | 9/1991 | |

* cited by examiner

*Primary Examiner*—Margaret Medley
*Assistant Examiner*—Cephia D. Toomer

(57) ABSTRACT

A two-cycle oil is disclosed comprising a polyisobutylene amine, a dispersant, a polybutene polymer, solvent and lubricating oil which exhibits improved performance.

12 Claims, No Drawings

TWO-CYCLE LUBRICATING OIL CONTAINING POLYISOBUTYLENE AMINE

This invention relates to a lubricant composition useful as a two-cycle oil. Two-stroke-cycle gasoline engines now range from small, less than 50 cc engines, to higher performance engines of 200 to 500 cc. The development of such high performance engines has created the need for new two-cycle oil standards and improved lubricants which satisfy these standards.

Two-cycle engines are lubricated by mixing the fuel and lubricant and allowing the mixed composition to pass through the engine. Various types of two-cycle oils, compatible with fuel, have been described in the art. Typically, such oils contain a variety of additive components in order for the oil to pass industry standard tests to permit use in two-cycle engines.

The present invention is based on the discovery that the use of a combination of polyisobutylene amine and a nitrogen containing dispersant results in an improved two-cycle oil.

Accordingly, there has been discovered a two-cycle lubricating oil composition having a Brookfield viscosity of about 2,000 to 7,500 cps at −25° C. comprising an admixture of the following:

(a) 1.5–8% by weight (active ingredient basis) of a polyisobutylene amine, the polyisobutylene having an Mn (number average) molecular weight of about 400–1500;

(b) 2.5–8% by weight (active ingredient basis) of a nitrogen-containing lubricating oil dispersant being a reaction product of an oil soluble hydrocarbyl substituted carboxylic acylating agent and a polyamine;

(c) 5–30% by weight of a polybutene polymer having an Mn molecular weight of about 900–1500;

(d) 10–45% by weight of a normally liquid hydrocarbon solvent having a boiling point range of about 120–380° C. and a flash point in the range of 55–140° C.; and (e) the balance an oil of lubricating viscosity.

Polyisobutylenes useful in this invention for preparing polyisobutylene amines generally have an average Mn molecular weight of about 400–1500, preferably 900–1200, and the polyisobutylene amine can be prepared by chlorination or hydroformylation of a reactive polyolefin such as polyisobutylene, and subsequent amination with ammonia, hydrocarbyl amine or diamine, hydrocarbyl polyamine, alkoxylated hydrocarbyl amines, or mixture thereof. Ammonia, ethylenediamine, propylenetriamine, diethylenetriamine, triethylenetetramine, hydroxyalkylethylenediamines, hydroxyalkyl triethylenetetramines, and similar compounds can be converted to polyalkyleneamines by these procedures. Mixtures of the above and similar amines can also be used effectively. Alternatively, these amines can be prepared by chlorination or halogenation of appropriate polymeric olefins, and then converted into corresponding polyalkyleneamine derivatives using these or other known methods of manufacture. They are preferably used in amounts of 6–7 wt. % in the present invention.

Particularly preferred is a polyisobutylene amine prepared from ethylene diamine and Mn 1200 polyisobutylene (PIB). It is preferably present in an amount of about 6–7% by weight on an active ingredient basis, the additive normally being provided in a solution of mineral oil containing about 50–75% by weight PIB amine, such as about 60% by weight.

The (b) component of the two-cycle oils of this invention is a lubricating oil nitrogen-containing carboxylic dispersant present in an amount of about 2.5–8% by weight, preferably about 6–7% by weight. These percentages do not include the mineral oil carriers commonly used in the dispersant products and are therefore on an active ingredient (a.i.) basis. The active ingredient content of such dispersants is typically about 50–95% by weight.

The nitrogen-containing carboxylic dispersants include amine reaction products of hydrocarbyl-substituted carboxylic acylating agents such as substituted carboxylic acids or derivatives thereof. Typically the amines are polyamines, preferably the amines are ethylene amines, amine bottoms or amine condensates. The hydrocarbyl-substituted carboxylic acylating agent and polyamine are reacted at a temperature from about 0° C., preferably about 50° C., up to about 200° C., preferably up to about 150° C. Usually an equivalent of acylating agent is reacted with 1–4 equivalents of polyamine, preferably 2–4 equivalents.

The hydrogen-substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc., preferably acid, esters or anhydrides, more preferably anhydrides. Preferably the carboxylic acylating agent is a succinic acylating agent.

The hydrocarbyl-substituted carboxylic acylating agent includes agents which have a hydrocarbyl group derived from a polyalkene. The polyalkene is characterized as containing from at least about 8 carbon atoms, preferably at least about 30, more preferably at least 35 up to about 300 carbon atoms, preferably 200, more preferably 100. In one embodiment, the polyalkene is characterized by an Mn (number average molecular weight) value of at least about 500. Generally, the polyalkene is characterized by an Mn value of about 500 to about 5000, preferably about 800 to about 2500. In another embodiment Mn varies between about 500 to about 1200.

Preferred for use in the oils of this invention are polyisobutenyl succinimide dispersants where the polyisobutenyl group has an Mn of about 450–1500, more preferably 900–1200, especially about 950.

The polyalkenes include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the interpolymer is a homopolymer. An example of a preferred homopolymer is a polybutene, preferably a polybutene in which about 50% of the polymer is derived from isobutylene. The polyalkenes are prepared by conventional procedures.

The hydrocarbyl-substituted carboxylic acylating agents are prepared by a reaction of one or more polyalkenes with one or more unsaturated carboxylic reagent. The unsaturated carboxylic reagent generally contains an alpha-beta olefinic unsaturation. The carboxylic reagents may be carboxylic acids per se and functional derivatives thereof, such as anhydrides, esters, amides, imides, salts, acyl halides, and nitriles. These carboxylic acid reagents may be either monobasic or polybasic in nature. When they are polybasic they are preferably dicarboxylic acids, although tri- and tetracarboxylic acids can be used. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, fumaric acid, mesaconic acid, itaconic acid and citraconic acid. Generally, the unsaturated carboxylic acid or derivative is maleic anhydride or maleic or fumaric acid or ester, preferably, maleic acid or anhydride, more preferably maleic anhydride.

The polybutene polymer useful as component (c) in the two-cycle lubricating oil compositions of this invention is a mixture of poly-n-butenes and polyisobutylene which normally results from the polymerization of $C_4$ olefins and generally will have a number average (Mn) molecular weight of about 900 to 1500 with a polyisobutylene or polybutene having a number average molecular weight of about 950 to 1300 being particularly preferred for component (c). The preferred amount is 7–8 wt. % in the two-cycle oils of the invention. Most preferable is a mixture of polybutene and polyisobutylene having a number average molecular weight of about 950. Number average molecular weight (Mn) is measured by gel permeation chromatography. Polymers composed of 100% polyisobutylene or 100% poly-n-butene are also within the scope of this invention and within the meaning of the term "a polybutene polymer".

A preferred polybutene polymer is a mixture of polybutenes and polyisobutylene prepared from a $C_4$ olefin refinery stream containing about 6 wt. % to 50 wt. % isobutylene with the balance a mixture of butene (cis- and trans-) isobutylene and less than 1 wt. %. butadiene. Particularly, preferred is a polymer prepared from a $C_4$ stream composed of 6–45 wt. % isobutylene, 25–35 wt. % saturated butenes and 15–50 wt. % 1- and 2-butenes. The polymer is prepared by Lewis acid catalysis.

The solvents useful in the present invention as the (d) component may generally be characterized as being normally liquid petroleum or synthetic hydrocarbon solvents having a boiling point range of about 120–380° C. at atmospheric pressure (ASTM D2887). Such a solvent should also have a flash point in the range of about 55–140° C. Typical examples include kerosene, hydrotreated kerosene, middle distillate fuels, isoparaffinic and naphthenic aliphatic hydrocarbon solvents, dimers, and higher oligomers of propylene butene and similar olefins as well as paraffinic and aromatic hydrocarbon solvents and mixtures thereof. Such solvents may contain functional groups other than carbon and hydrogen provided such groups do not adversely affect performance of the two-cycle oil. Preferred is an aliphatic hydrocracked light hydrocarbon distillate having a boiling point range of about 199–288° C. and a viscosity of 1.71 cSt at 40° C. The solvents are present in amounts of from 10–45% by weight, preferably about 18–20% by weight.

The (e) component of the lubricating compositions of this invention is an oil of lubricating viscosity, that is, a viscosity of about 55–180 cSt at 40° C.

These oils of lubricating viscosity for this invention can be natural or synthetic oils. Mixtures of such oils are also often useful.

Natural oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils such as polymerized and interpolymerized olefins alkylated diphenyl ethers and alkylated diphenyl sulfides and the derivatives, analogs and homologs thereof.

Oils made by polymerizing olefins of less than 5 carbon atoms and mixtures thereof are typical synthetic polymer oils. Methods of preparing such polymer oils are well known to those skilled in the art as is shown by U.S. Pat. Nos. 2,278,445; 2,301,052; 2,318,719; 2,329,714; 2,345,574; and 2,422,443.

Alkylene oxide polymers (i.e., homopolymers, interpolymers, and derivatives thereof where the terminal hydroxyl groups have been modified by esterification, etherification, etc.) constitute a preferred class of known synthetic lubricating oils for the purpose of this invention, especially for use in combination with alkanol fuels. They are exemplified by the oils prepared through polymerization of ethylene oxide or propylene oxide, the alkyl and aryl ethers of these polyoxyalkylene polymers (e.g., methyl polypropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, octyl alcohol, dodecyl alcohol, tridecyl alcohol, 2-ethylhexyl alcohol, ethylene glycol, diethylene glycol monoether, propylene glycol, etc.). Specific examples of these esters include dioctyl adipate, di(2-ethylhexyl)sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$–$C_{18}$ monocarboxylic acids and polyols and polyol ethers such as neopentyl glycol, trimethyl propane, pentaerythritol, dipentaerythritol, tripentaerythritol, etc.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or an ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils which have been already used in service. Such rerefined oils are also known as reclaimed or reprocessed oils and often are additionally processed by techniques directed to removal of spent additive and oil breakdown products.

Oils of this invention may also contain small proportions of various special purpose conventional lubricating oil additives.

Additional conventional additives for lubricating oils which may be present in the composition of this invention include viscosity modifiers, corrosion inhibitors, oxidation inhibitors, friction modifiers, dispersants, antifoaming agents, antiwear agents, lube oil flow improvers, pour point depressants, detergents, rust inhibitors and the like.

Typical oil soluble viscosity modifying polymers will generally have weight average molecular weights of from about 10,000 to 1,000,000 as determined by gel permeation chromatography.

Corrosion inhibitors are illustrated by phosphosulfurized hydrocarbons and the products obtained by reacting a phosphosulfurized hydrocarbon with an alkaline earth metal oxide or hydroxide.

Oxidation inhibitors are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamine as well as sulfurized or phospho sulfurized hydrocarbons. Also included are oil soluble antioxidant copper compounds such as copper salts of $C_{10}$–$C_{18}$ oil soluble fatty acids.

Friction modifiers include fatty acid esters and amides, glycerol esters of dimerized fatty acids and succinate esters or metal salts thereof.

Pour point depressants also known as lube oil flow improvers can lower the temperature at which the fluid will flow and typical of these additives are $C_8$–$C_{18}$ dialkyl fumarate vinyl acetate copolymers, which are preferred in amounts of about 0.1 to 1.0 wt. % (active ingredient basis), polymethacrylates and wax naphthalene.

Foam control can also be provided by an anti foamant of the polysiloxane type such as silicone oil and polydimethyl siloxane.

Anti-wear agents reduce wear of metal parts and representative materials are zinc dialkyldithiophosphate and zinc diaryl diphosphate.

Detergents and metal rust inhibitors include the metal salts of sulfonic acids, alkylphenols, sulfurized alkylphenols, alkyl salicylates, naphthenates and other oil soluble mono and dicarboxylic acid. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur.

Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

The oils of this invention are prepared by simply combining and admixing the aforesaid ingredients at room temperature and a further aspect of this invention are oils prepared by mixing together the aforesaid ingredients (a), (b), (c), (d) and (e).

An advantage of the two-cycle oils of this invention is that they satisfy relevant tests for both land-based equipment, such as snowmobiles, and for water-cooled marine engines. A particular advantage is the fact that the oils of this invention do not contribute to the clogging of variable exhaust systems used in land-based equipment which has been observed with many conventional two-cycle formulations used heretofore in equipment such as snowmobiles.

The lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline, especially lead-free gasoline, as defined by ASTM specification D-439-73. Such fuels can also contain non-hydrocarbonaceous materials such as alcohols, ethers, organo nitro compounds and the like, e.g., methanol, ethanol, diethyl ether, methylethyl ether, nitro methane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitro methane, etc.

The lubricants of this invention are used in admixture with fuels such as lead-free gasoline, in amounts of about 20–250 parts by weight of fuel per 1 part by weight of lubricating oil, more typically about 30–100 parts by weight of fuel per 1 part by weight of oil.

The invention is further illustrated by the following examples which are not to be considered as limitative of its scope.

EXAMPLE 1

A two cycle engine lubricating oil composition having a Brookfield viscosity 6480 at −25° C. was prepared by combining the following ingredients:

| Component | Wt. % | Vol. % |
|---|---|---|
| (a) polyisobutenyl (Mn 1200) amine (ethylene diamine) (60 wt. % active ingredient) | 10.421 | 10.00 |
| (b) polyisobutenyl (Mn 950) succinimide dispersant (50 wt. % active ingredient) | 12.824 | 12.00 |
| (c) $C_8$–$C_{18}$ dialkyl fumarate - vinyl acetate pour depressant (40 wt. % active ingredient) | 0.421 | 0.40 |
| (d) $C_{14}$ dialkyl fumarate - vinyl acetate pour depressant (88 wt. % active ingredient) | 0.111 | 0.10 |
| (e) Mn 950 polyisobutylene | 7.711 | 7.50 |
| (f) hydrocarbon solvent | 18.924 | 21.00 |
| (g) mineral oil | 49.588 | 49.00 |
| | 100% | 100% |

The oil was tested and satisfied the requirements of OMC's modified 70 HP Detergency Test. The undercrown ratings in the table below are especially noteworthy.

| Undercrown Ratings | | | |
|---|---|---|---|
| Cylinder | 1 | 2 | 3 |
| Example 1 Oil | 3.4 | 9.3 | 9.6 |

The oil of Example 1 of this invention was tested in the Arctic Cat Snowmobile Field Test; results are below. These results satisfy the requirements of this test.

| Evaluation | Example 1 Oil |
|---|---|
| Inside Sliding Surface (F-Left) | 9 |
| Inside Sliding Surface (F-Right) | 9 |
| Inside Sliding Surface (B-Left) | 4 |
| Inside Sliding Surface (B-Right) | 5 |
| Outside Surface (F-Left) | 9 |
| Outside Surface (F-Right) | 9 |
| Outside Surface (B-Left) | 9 |
| Outside Surface (B-Right) | 9 |

-continued

| Evaluation | Example 1 Oil |
|---|---|
| Face of Front (Left) | 4 |
| Face of Front (Right) | 5 |
| Face of Back (Left) | 6 |
| Face of Back (Right) | 6 |
| Neck (B-Left) | 8 |
| Neck (B-Right) | 8 |
| | 100 |

Film Residue (6 = Worst) 1

What is claimed is:

1. A two-cycle lubricating oil composition having a Brookfield viscosity at −25° C. of about 2,000 to 7,500 cps which consists of an admixture of the following:

(a) 1.5–8% by weight (active ingredient basis) of a polyisobutylene amine, the polyisobutylene having an Mn molecular weight of about 400–1500;

(b) 2.5–8% by weight (active ingredient basis) of a nitrogen-containing lubricating oil dispersant being a reaction product of an oil soluble hydrocarbyl substituted carboxylic acylating agent wherein the hydrocarbyl substituent has an $M_n$ of about 450 to about 5000, and a polyamine;

(c) 7–8% by weight of a polybutene polymer having an Mn molecular weight of about 900–1500;

(d) 10–45% by weight of a normally liquid hydrocarbon solvent having a boiling point range of 120–380° C. and a flash point in the range of 55–140° C.; and (e) the balance an oil of lubricating viscosity.

2. The composition of claim 1 wherein there is present 6–7% of the (a) component, 6–7% of the (b) component, 18–20% of the (d) component and the (e) component is a mineral oil.

3. The composition of claim 1 or 2 wherein (a) is Mn 1200 polyisobutylene amine prepared from ethylene diamine.

4. The composition of claims 1 and 2 wherein (b) is Mn 950 polyisobutylene succinimide dispersant.

5. The composition of claim 1 or 2 wherein (c) is a polybutene polymer having an Mn of 950.

6. A fuel lubricant mixture suitable for use in two-cycle engines which comprises 20–250 parts by weight of fuel per 1 part by weight of lubricating oil composition of claim 1 or claim 2.

7. A two-cycle lubricating oil composition having a Brookfield viscosity at −25° C. of about 2,000 to 7,500 cps which consists of an admixture of the following:

(a) 1.5–8% by weight (active ingredient basis) of a polyisobutylene amine, the polyisobutylene having an Mn molecular weight of about 400–1500;

(b) 2.5–8% by weight (active ingredient basis) of a nitrogen-containing lubricating oil dispersant being a reaction product of an oil soluble hydrocarbyl substituted carboxylic acylating agent and a polyamine;

(c) 7–8% by weight of a polybutene polymer having an Mn molecular weight of about 900–1500;

(d) 10–45% by weight of a normally liquid hydrocarbon solvent having a boiling point range of 120–380° C. and a flash point in the range of 55–140° C.;

(e) 0.1–1.0 wt. % of a $C_8$–$C_{18}$ dialkylfumarate vinyl acetate copolymer lube oil flow improver; and (f) the balance an oil of lubricating viscosity.

8. The composition of claim 7 wherein there is present 6–7% of the (a) component, 6–7% of the (b) component, 7–8% of the (c) component and 18–20% of the (d) component and the (f) component is a mineral oil.

9. The composition of claim 7 or 8 wherein (a) is Mn 1200 polyisobutylene amine prepared from ethylene diamine.

10. The composition of claim 7 or 8 wherein (b) is Mn 950 polyisobutylene succinimide dispersant.

11. The composition of claim 7 or 8 wherein (c) is a polybutene polymer having an Mn of 950.

12. A fuel lubricant mixture suitable for use in two-cycle engines which comprises 20–250 parts by weight of fuel per 1 part by weight of lubricating oil composition of claim 7 or claim 8.

* * * * *